United States Patent [19]

Brodell et al.

[11] Patent Number: 4,884,950

[45] Date of Patent: Dec. 5, 1989

[54] SEGMENTED INTERSTAGE SEAL ASSEMBLY

[75] Inventors: Robert F. Brodell, Marlborough; Gabriel L. Suciu, Glastonbury, both of Conn.

[73] Assignee: United Technologies Corporation, Hartford, Conn.

[21] Appl. No.: 241,290

[22] Filed: Sep. 6, 1988

[51] Int. Cl.[4] ..... F01D 5/06

[52] U.S. Cl. ..... 416/174; 416/198 A; 416/95; 415/199.5; 415/173.7

[58] Field of Search ..... 415/172 A, 199.5; 416/174 A, 198 A, 200 A, 201 R, 95

[56] References Cited

U.S. PATENT DOCUMENTS

| | | | |
|---|---|---|---|
| 2,452,782 | 11/1948 | McLeod et al. | 416/201 R |
| 2,773,667 | 12/1956 | Wheatley | 416/174 A |
| 2,858,101 | 10/1958 | Alford . | |
| 3,056,579 | 10/1962 | Bobo . | |
| 3,094,309 | 6/1963 | Hull et al. | 416/201 R |
| 3,551,068 | 12/1970 | Scalzo et al. | 415/173 |
| 3,733,146 | 5/1973 | Smith et al. | 415/172 A |
| 3,744,930 | 7/1973 | Carroll | 416/174 |
| 3,868,197 | 2/1975 | Hugoson | 415/199.5 |
| 4,088,422 | 5/1978 | Martin | 416/201 R X |
| 4,094,673 | 6/1978 | Erickson et al. | 415/172 A X |
| 4,127,359 | 11/1978 | Stephan | 416/198 A |
| 4,309,147 | 1/1982 | Koster et al. | 416/95 |
| 4,432,697 | 2/1984 | Miura et al. | 416/198 A |
| 4,470,757 | 9/1984 | Vollinger | 416/221 |
| 4,484,858 | 11/1984 | Kurosawa et al. | 416/95 |
| 4,582,467 | 4/1986 | Kisling | 416/95 |
| 4,645,424 | 2/1987 | Peters | 415/172 A X |
| 4,659,289 | 4/1987 | Kalogeros | 415/172 A X |

FOREIGN PATENT DOCUMENTS

| | | | |
|---|---|---|---|
| 693040 | 11/1979 | U.S.S.R. | 416/198 A |
| 790029 | 1/1958 | United Kingdom | 416/201 R |

*Primary Examiner*—Everette A. Powell, Jr.
*Attorney, Agent, or Firm*—Troxell K. Snyder

[57] ABSTRACT

A segmented seal (36) is provided for sealing between two adjacent rotor disks (18, 20). The individual segments (36) includes sideplate members (42, 44) and integral hook members (50, 52) which engage the facing sides of the respective disks (18, 20). Strut members (60, 62) support the central portion (64) of the axially and circumferentially extending wall members (40) which collectively establish the radially inner gas boundary for an annular working fluid stream (30).

6 Claims, 2 Drawing Sheets

SEGMENTED INTERSTAGE SEAL ASSEMBLY

FIELD OF THE INVENTION

This invention relates to a seal assembly disposed between axially adjacent rotor disks in a gas turbine engine.

BACKGROUND

The need to seal between co-rotating rotor disks in the turbine or other sections of a gas turbine engine is a continuing problem. The environment which such seals must withstand includes exposure of at least one portion of the interdisk seal to the turbine working fluid having temperatures up to 2500F, withstanding the induced centrifugal force caused by high speed disk rotation, and accommodating thermal transient conditions caused by engine throttle changes. It is common for such seals to carry a portion of the rotating seal structure which is located between a stator vane assembly located axially intermediate the turbine disks. This rotating seal is typically comprised of an annular abradable member secured to the radially innermost portion of the stator vanes, and a series of knife edges extending circumferentially about the interdisk seal and extending radially outward into close contact with the abradable annular member. As will be well known to those skilled in the art, radial movement of the interdisk seal can cause the circumferential knife edges to move into contact with the abradable ring, opening a leakage path between the ring and knife edges during normal operating conditions.

One technique in the prior art to provide such interdisk seals has been the use of full ring seal members wherein a monolithic seal structure is established having a radially inner ring spanning the axial gap between the rotor disks, an annular outer wall member sealingly secured at axially opposite ends to the adjacent rotor disk rims, and a radially extending web member secured between the supporting ring and the outer wall for supporting the axially central portion of the outer wall. A drawback with this prior art seal member has been the occurrence of a thermal expansion mismatch between the rotor disks and the seal supporting ring.

During periods of rapid engine acceleration, the working fluid temperature increases rapidly causing the disk rims and seal assembly to also increase in temperature. The interdisk seal, being of significantly lower mass than the disk members, increases in temperature more rapidly and hence experiences more rapid thermal expansion. The differential thermal expansion induced by the uneven temperature rise can cause excessive hoop stresses in portions of the full annular interdisk seal member which may be as great or greater than the hoop stress resulting from the rotation induced centrifugal force. Such monolithic interdisk seals must be fabricated of high strength materials in order to withstand the hoop stresses induced by rotation and the thermal growth mismatch discussed hereinabove. Such strength requires a heavier seal structure further penalizing the overall engine by imposing additional weight adjacent the rotor disk rims.

What is needed is a lightweight interdisk seal which is able to accommodate differential thermal growth between the seal member and the adjacent turbine disks, which can withstand the rotation induced forces, and which is dimensionally stable in the radial direction to avoid excessive radial movement of the rotating knife edges.

SUMMARY OF THE INVENTION

It is therefore an object of the present invnetion to provide a means for sealing the annular gap between two axially spaced rotor disks in an axial flow turbomachine. It is further an object of the present invention to provide a sealing means adapted to accommodate differential thermal expansion between the rotor disks and the sealing means as may result from transient thermal conditions in the turbomachine.

It is further an object of the present invention to provide a circumferentially segmented sealing means supported wholly by the rotor disks.

It is still further an object of the present invention to provide a sealing means defining an internal cooling air distribution manifold for distributing cooling air about the periphery of at least one of the rotor disks.

According to the present invention, the annular gap formed between two axially spaced rotor disks is sealed against radially or axially flowing turbine working fluid by an annular seal assembly. The seal assembly comprises a plurality of individual segments arranged about the periphery of the rotor disks and extending axially therebetween.

Each segment includes a gas tight wall member extending axially between facing sides of the rotor disks and circumferentially between the corresponding wall members of the circumferentially adjacent segments. The wall members collectively define an annular gas barrier between the axially flowing working fluid and the radially inward volume between the rotor disks. Axial flow of the working fluid gas between the blade root portions secured to the disk rim is prevented by first and second sealing sideplates, integral with the seal segments and extending radially inward of the wall member. The sideplates fit closely with the disk rims, thereby preventing axial flow radially inward of the blade platforms.

Each segment further includes a pair of axially extending hook members, engaged with the adjacent rotor disks, for radially retaining each segment. A truss, including two diagonal struts extending from adjacent each of the hook members to an axially central portion of the wall member, provides stiffening for the wall member against radial deflection due to radially induced centrifugal force. The struts further define a cooling air manifold for distributing cooling air about the periphery of at least one of the disks. Such cooling air may be routed into each of the blades secured to the disk rim or otherwise directed for protecting the rotating components against the high temperature working fluid.

Unlike prior art monolithic seals, the seal assembly according to the present invention avoids differential thermal growth between the adjacent rotor disks and the seal member resulting from transient temperature changes as, for example, during rapid acceleration of the turbomachine. The circumferentially segmented design of the seal according to the present invention eliminates all hoop stress in the seal assembly. The truss arrangement of the segmented seal further supports the axially central portion of the radially outer seal wall, thereby maintaining seal rigidity while allowing the seal members to expand and contract radially with the supporting rotor disks.

The elimination of hoop stress in the segmented seal permits a reduction in the required thickness of the segment components, reducing overall seal weight and radial loading on the rotor disks.

Both these and other objects and advantages of the segmented seal according to the present invention will become apparent to those skilled in the art upon review of the following specification and the appended claims and drawing figures.

DETAILED DESCRIPTION OF THE PREFERRED EMBODIMENT

Figure 1:
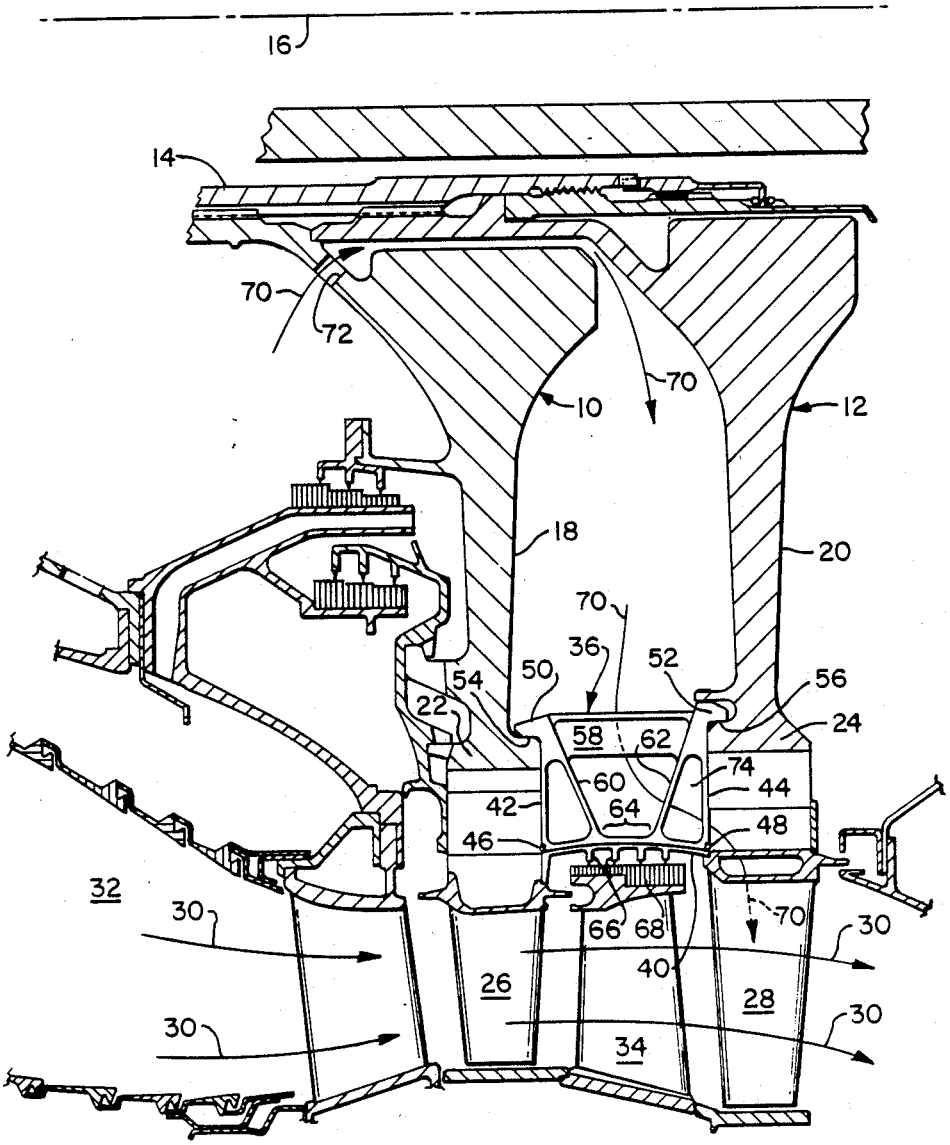
FIG. 1 is a cross section of a multi-stage gas turbine taken in the plane of the central axis.

Referring to the drawing figures, and in particular to FIG. 1 thereof, the present invention will be described in the environment of a two-stage turbine section having a first rotor assembly 10 and a second rotor assembly 12, both of which are affixed to a shaft 14 having a central axis 16. The rotors 10, 12 are comprised of radially outer disk portions 18, 20 each having a periphery or rim portion 22, 24 which is adapted to receive a series of turbine blades 26, 28. Means for securing turbine blades and disk rims are well known, including for example the use of a ribbed blade root portion which slides axially during assembly into a similarly shaped slot in the disk periphery.

The blades 26, 28 are disposed in a flow of working fluid 30 which is pressurized in an upstream compressor portion (not shown) and heated to working temperature in a combustor section 32 disposed upstream of the turbine blades 26, 28. A stator vane 34 is disposed in the working fluid stream 30 between the blade stages 26, 28 for optimally directing the working fluid entering the downstream blade section 28.

The seal assembly according to the present invention is comprised of a plurality of individual seal segments 36 disposed between the first and second rotors 10, 12 for sealing between the axially flowing working fluid 30 and the radially inner volume 38 defined between the disks 18, 20. The seal segments 36 each comprise a wall member 40 extending axially between the first rotor disk 18 and the second rotor disk 20 and circumferentially between corresponding wall members (not shown) of circumferentially adjacent seal segments. The seal segment 36 also includes first and second sideplate members 42, 44 each disposed adjacent respective rim portions 22, 24 of the rotor disks 18, 20 and including circumferentially extending sealing means such as wire seals 46, 48 as shown in FIG. 1.

The sidewall members 42, 44 extend radially inward from the wall member 40 forming integral hook members 50, 52 which engage corresponding shoulders 54, 56 in the disks 18, 20. The hook members 50, 52 restrain the seal segment 36 from radial movement during operation of the gas turbine engine. An axially extending web member 58 stiffens the seal segment 36 against axial deflection and maintains the disk rims 22, 24 at a uniform axial displacement.

The seal segment 36 according to the present invention also includes an internal truss, comprised of strut members 60, 62 extending both radially and axially from respective hook portions 50, 52 to the axially central portion 64 of the wall member 40. The strut members 60, 62 support the central portion 64 of the wall member 40 reducing radial deflection caused by induced centrifugal force due to rotation of the first and second rotors 10, 12. The outer wall member 40 of the seal segments 36 also includes a plurality of circumferentially extending knife edges 66 which, in cooperation with an abradable annular seal 68 supported by the stator vanes 34, prevents bypassing of the stator vanes 34 by the working fluid 30 in the axial direction.

Another feature of the seal assembly according to the present invention is the ability to distribute cooling air about the rims 22, 24 of the rotor disk 18, 20. Again referring to FIG. 1, a flow of cooling air 70 enters the volume 38 via an opening 72 disposed in the low stress hub portion of the first rotor 10. The cooling air 70 enters the segmented seal 36 between the axially extending web members 58, and enters a manifold volume 74 defined by the second sideplate 44, the wall member 40 and the second strut 62. Openings (not shown in FIG. 1) in the sideplate 44 admit the cooling air 70 into the periphery 24 of the disk 20 whence it may be directed into the interior of the corresponding blades 28 as is well known in the prior art. This provision for distributing cooling air about the periphery 24 of the second disk 20 simplifies the cooling of the second stage blades 28 increasing blade service life and thereby reducing repair and maintenance costs.

Figure 2:
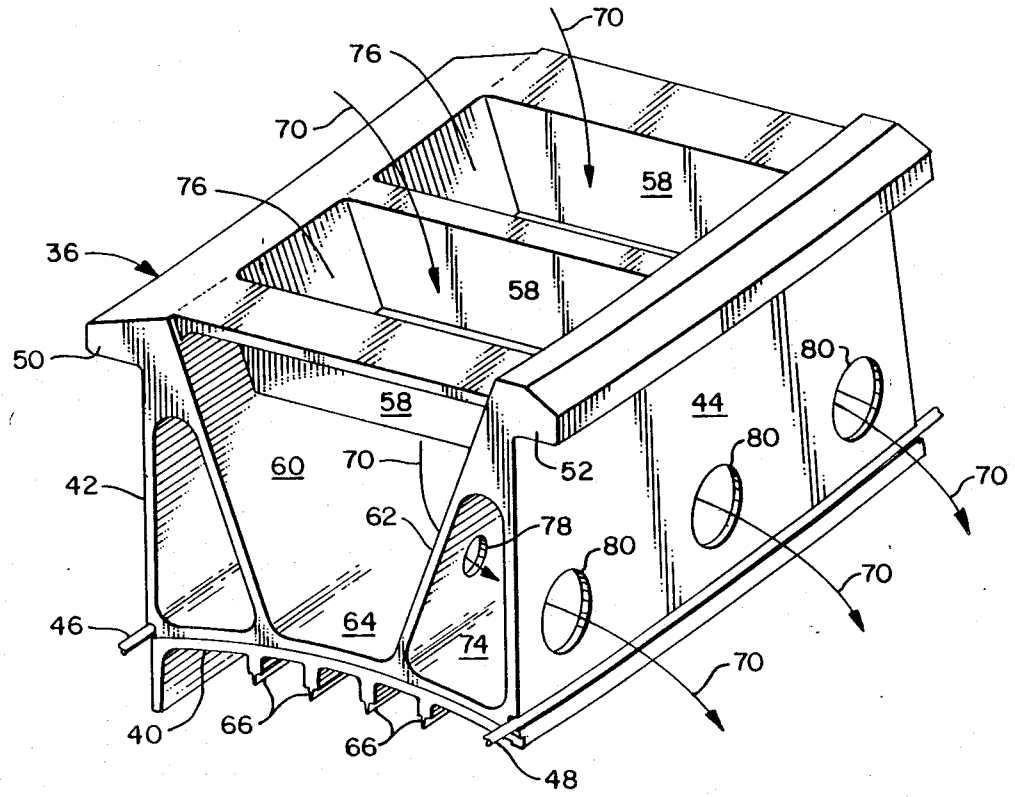
FIG. 2 is a perspective view of one seal segment according to the present invention.

FIG. 2 shows a perspective view of a single seal segment 36 removed from the engine. As discussed above, the outer wall member 40 including the knife edge portions 66 of the rotating seal extends axially and circumferentially to define a gas-tight barrier for preventing radial flow of the working fluid.

Axially spaced hook members 50, 52 extend circumferentially for evenly distributing the radial loading caused by rotation of the rotors 10, 12 and seal members 36. Webs 58 extend between the hook portions 50, 52 and, together therewith, define radially facing openings 76 for admitting the cooling air 70 into the seal segment 36. Strut members 60, 62 are shown extending between the respective hook members 50, 52 and the axially central portion 64 of the wall member 40. Cooling air 70 passes into the manifold volume 74 via metering holes 78 disposed in the strut 62. The manifold volume 74 evenly distributes the cooling air 70 among a plurality of outlet holes 80 disposed in the sidewall 44.

Each seal segment 36 according to the present invention is supported wholly by the adjacent disks 18, 20 which are tensioned axially against the segment sideplates 42, 44 during assembly of the engine. Adjacent seal segments 36 have matching common feather seals disposed between circumferentially adjacent segments to prevent radial leaking of the working fluid 30 between segments.

The sideplates 42, 44 are engaged with the respective disk rims 22, 24 and blades 26, 28 by a combination of shiplap surfaces disposed in the sideplates 42 adjacent the disk rims 22, 24, and the wire seals 46, 48 which comprise a length of soft wire extending about the circumference of the disk rim and compressed between the seal segments 36 and the opposing faces of the disk rims 22, 24. It should be noted that such sealing between components in a gas turbine engine which do not move relative to each other may utilize any of a variety of sealing structures and methods, and that the segment according to the present invention is adaptable to utilize such alternate methods as may be indicated by the temperature, stress, and differential pressure involved.

The seal segment 36 according to the present invention is well suited for exposure to high temperature working fluid 30 due to the internal truss arrangement including the struts 60, 62 and the axially extending webs 58 which provide both radial and axial stability to the segments 36. The segmented structure, by relying on the rotor disks 18, 20 for radial support, does not experience tensile hoop stress resulting from centrifugal loading during engine operation, and likewise does not experience compressive hoop stress due to differential thermal expansion of the seals with respect to the adjacent disks. The elimination of all hoop stress thus permits a reduction in overall seal material and weight, thereby further reducing the load on the individual seal components which may be fabricated from materials better suited to withstand the high temperatures associated with the working fluid 30.

The seal segment according to the present invention futher incorporates a variety of interdisk sealing functions providing both a gas tight barrier for preventing working fluid flow radially into the inner disk volume 38, but also providing radially extending sideplate seals 42, 44 for inhibiting axial flow of the working fluid 30 through the disk rim portions 22, 24. Although disclosed in terms of an interdisk seal in a turbine section of a gas turbine engine, it will be appreciated by those skilled in the art that the seal assembly and segments 36 according to the present invention are well suited for application in compressor sections as well as other co-rotating machine elements in turbomachines and other applications wherein it is desired to provide a simple, lightweight annular seal structure.

We claim:

1. Means for providing a gas-tight seal between a first rotor and a co-rotating second rotor in an axial flow turbomachine, comprising:

a plurality of seal segments, disposed between a disk portion of the first rotor and a disk portion of the second rotor, the plurality of segments collectively forming an annular seal assembly extending axially between the first and second rotor disk and rotating therewith, each segment further including a radially outer, gas-tight wall, extending circumferentially into sealing engagement with the radially outer, gas-tight walls of the two adjacent seal segments, further extending axially between the first rotor disk and the second rotor disk and being sealingly engaged therewith, the radially outer, gas-tight walls of the plurality of segments collectively defining a gas-tight annular barrier between the first and second rotor disks;

wherein the seal segments each further include, first means, engaged with the first rotor disk for radially supporting the seal segment, second means, engaged with the second rotor disk for radially supporting the seal segment, and means, including a truss member, extending between the first supporting means and an axially cental portion of the radially outer wall of the segment for radially supporting the segment outer wall.

2. A circumferentially segmented, annular seal assembly disposed axially between a first rotor disk and a co-rotating second rotor disk, including a plurality of identical seal segments disposed circumferentially about rim portions of the first and second rotor disk, wherein the individual seal segments each comprise:

a radially outer wall member extending axially between the rotor disks and circumferentially between the adjacent seal segments, the outer wall members of the seal segments collectively defining an annular, gas tight barrier between the first and second rotor disks, a first means, engaged with the first rotor, and a second means, engaged with the second rotor disk, for radially retaining the seal segment, and a truss adapted to support an axially central portion of the outer wall member intermediate the rotor disks, including a first strut extending radially and axially between the first supporting means and the center portion of the outer wall member, and a second strut, extending radially and axially between the first supporting means and the center portion of the outer wall member.

3. The seal assembly as recited in claim 2, wherein the first supporting means includes a first axially extending hook member radially engaged with the first rotor disk, and a radially extending first sideplate extending between the first hook member and a portion of the outer wall member axially adjacent the first rotor disk.

4. The seal assembly as recited in claim 3, further comprising an axially extending web member, extending between the first hook member and the second supporting means.

5. The seal assembly as recited in claim 3, wherein the first strut, the first sideplate, and the wall member of the seal segments collectively define an annular cooling air distribution manifold, said manifold including, disposed in the strut members, means for receiving a flow of cooling air into said manifold volume and, disposed in the sideplate, means for distributing the received cooling air flow at the periphery of the second rotor disk.

6. A seal segment for establishing, in cooperation with a plurality of like segments, an annular gas-tight seal between a first rotor and a co-rotating second rotor in an axial flow turbomachine, comprising:

a radially outer, gas-tight wall, extending circumferentially into sealing engagement with the radially outer, gas-tight walls of two adjacent like seal segments, further extending axially between the first rotor and the second rotor and being sealingly engaged therewith, for defining a portion of a gas-tight annular barrier between the first and second rotors:

a first axially extending hook member radially engaged with the first rotor, a radially extending first sideplate extending between the first hook member and a portion of the outer wall member axially adjacent the first rotor, a second axially extending hook member radially engaged with the second rotor, a radially extending second sideplate extending between the second hook member and a portion of the outer wall member axially adjacent the second rotor, and means, including a truss member, extending between the first supporting means and an axially central portion of the radially outer wall of the segment for radially supporting the segment outer wall.

* * * * *